US006129266A

United States Patent [19]

Oliff et al.

[11] Patent Number: 6,129,266

[45] Date of Patent: Oct. 10, 2000

[54] CARTON WITH REINFORCED HANDLE STRUCTURE

[75] Inventors: James R. Oliff, Douglasville; Aaron Bates, Marietta; John M. Holley, Jr., Lawrenceville, all of Ga.

[73] Assignee: The Mead Corporation, Dayton, Ohio

[21] Appl. No.: 09/336,502

[22] Filed: Jun. 18, 1999

[51] Int. Cl.[7] ..... B65D 5/468

[52] U.S. Cl. ..... 229/117.13; 229/117.12

[58] Field of Search ..... 229/117.12, 117.13; 206/141, 427

[56] References Cited

U.S. PATENT DOCUMENTS

| | | | |
|---|---|---|---|
| 2,482,399 | 9/1949 | Bullock | 229/117.13 |
| 2,896,838 | 7/1959 | Struble | 229/117.12 |
| 3,094,268 | 6/1963 | Swanson et al. | 229/117.13 |
| 3,300,119 | 1/1967 | Chaussadas | 206/434 |
| 3,371,846 | 3/1968 | Detzel | 229/117.13 |
| 3,933,303 | 1/1976 | Kirby, Jr. | 229/117.13 |
| 5,333,734 | 8/1994 | Stout et al. | 206/427 |
| 5,385,234 | 1/1995 | Stout et al. | 206/427 |
| 5,480,091 | 1/1996 | Stout | 229/117.14 |
| 5,593,027 | 1/1997 | Sutherland | 206/170 |
| 5,826,782 | 10/1998 | Stout | 229/117.13 |
| 5,873,515 | 2/1999 | Dunn et al. | 229/117.13 |

FOREIGN PATENT DOCUMENTS

| | | | |
|---|---|---|---|
| 1489093 | 6/1967 | France | 206/141 |
| 2274509 | 1/1976 | France | 229/117.13 |

*Primary Examiner*—Gary E. Elkins
*Attorney, Agent, or Firm*—Michael V. Drew

[57] ABSTRACT

A handle structure for a carton 12 is formed within a panel 20, 28 having a strap member 14, 44, 46 extending between end edges of the panel. An elongated web 54 extends diagonally from an intersection of side and end edges of the panel. The elongated web 54 includes a perforated line 57 and a score line 56 intermediate the perforated line and the end edge of the panel. A connecting tab 70 lies intermediate the end region of the strap member and foldably interconnects the strap member with a region of the panel that lies between the strap member and one of the side edges of the panel. The perforated line and score line of the elongated web intersect at a point distal the vertex of side and end edges.

45 Claims, 3 Drawing Sheets

CARTON WITH REINFORCED HANDLE STRUCTURE

TECHNICAL FIELD OF THE INVENTION

The invention relates to cartons, and more particularly, to cartons having a reinforced handle structure that enhances carton integrity and appearance.

BACKGROUND OF THE INVENTION

Handles are useful in cartons as a means for transporting the cartons. It is often desirable to have a carton that presents walls that are as aesthetically appealing as possible to potential purchasers of the package formed by the carton. Thus, it can be appreciated that it would be desirable to have a carton with a handle structure that functions within a carton wall or panel that is also aesthetically appealing.

SUMMARY OF THE INVENTION

According to a preferred embodiment of the invention, a handle structure for a carton is formed within a panel having a strap member extending between end edges of the panel. An elongated web extends diagonally from an intersection of side and end edges of the panel. The elongated web includes a perforated line and a score line intermediate the perforated line and the end edge of the panel.

In another aspect of the preferred embodiment, a connecting tab lies intermediate the end region of the strap member and foldably interconnects the strap member with a region of the panel that lies between the strap member and one of the side edges of the panel.

In another aspect of the preferred embodiment, the perforated line and score line of a web intersect at a point distal the end edge of the panel.

In still another aspect of the preferred embodiment, the strap member is defined by opposing edges and a portion of at least one of the opposing edges of the strap member is coincident with the score line.

In a further aspect of the preferred embodiment of the invention, the strap member tapers inwardly, and a connecting tab interconnects the strap member with a region of the panel intermediate the strap member and one of the side edges.

In a still further aspect of the preferred embodiment, a portion of an edge of the strap member is coincident with the score line and terminates at the connecting tab described immediately above.

In still an additional aspect of the preferred embodiment, an arcuate fold line traverses the end region of the strap member and is substantially coincident with the perforated lines of the elongated webs.

Other advantages and objects of the present invention will be apparent from the following description, the accompanying drawings, and the appended claims.

DETAILED DESCRIPTION OF THE PREFERRED EMBODIMENTS

Figure 1:
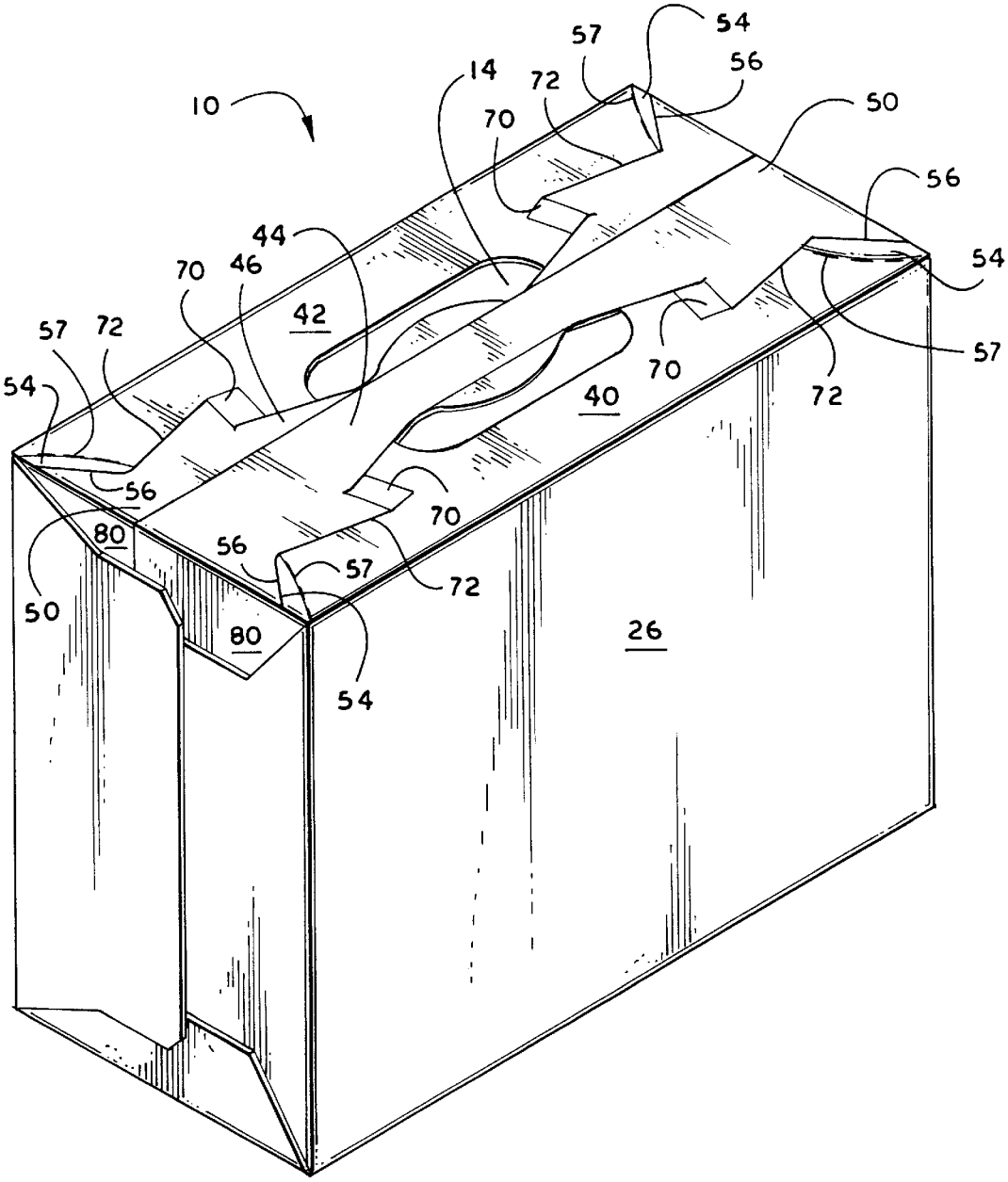
FIG. 1 is an isometric illustration of a carton having a handle structure in accordance with a preferred embodiment of the invention.

Throughout the drawings, the same reference numerals are used to denote the same or like features of the invention.

Figure 2:
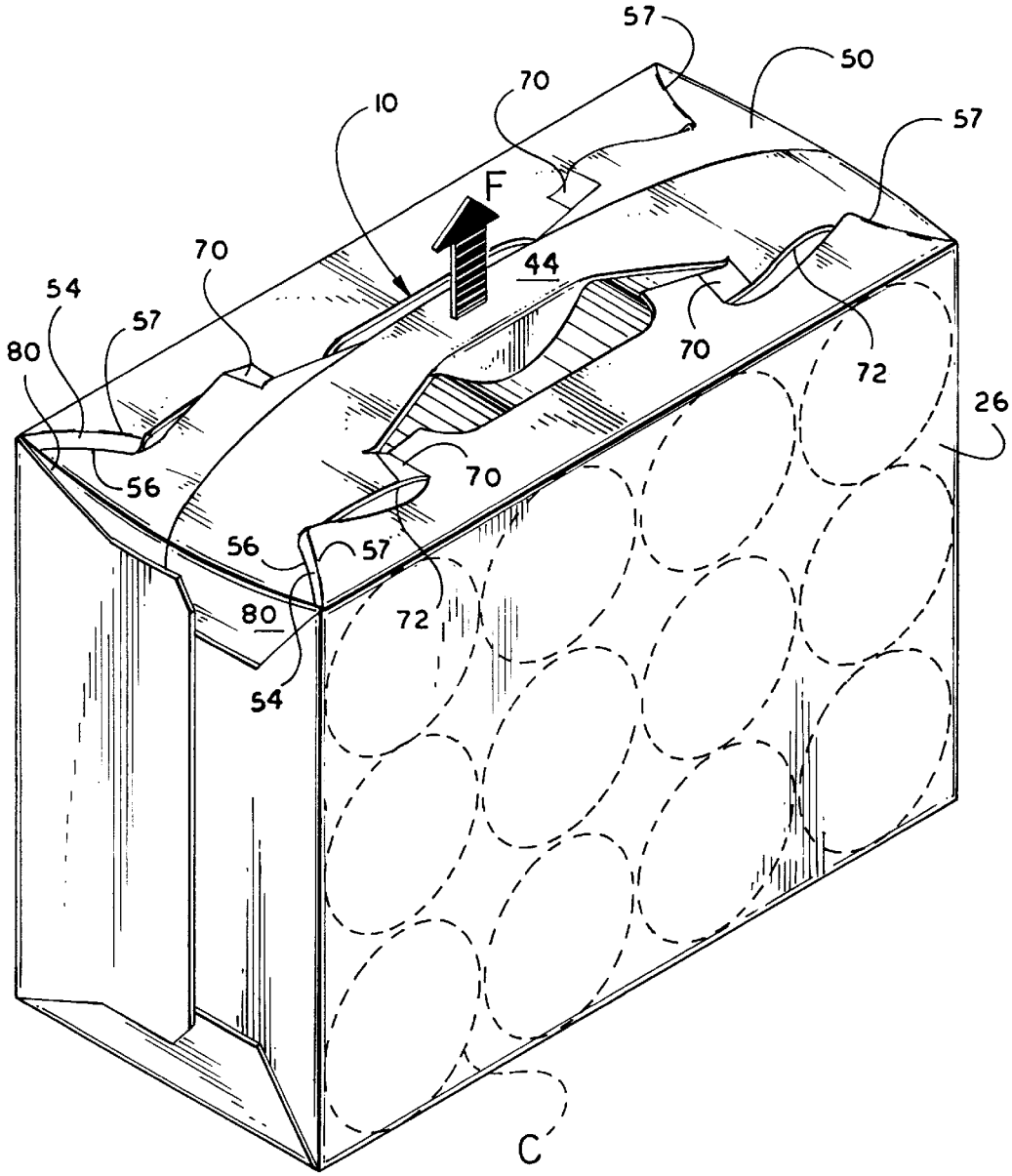
FIG. 2 is an isometric illustration of the carton of FIG. 1 with the handle member lifted upwardly.
Figure 3:
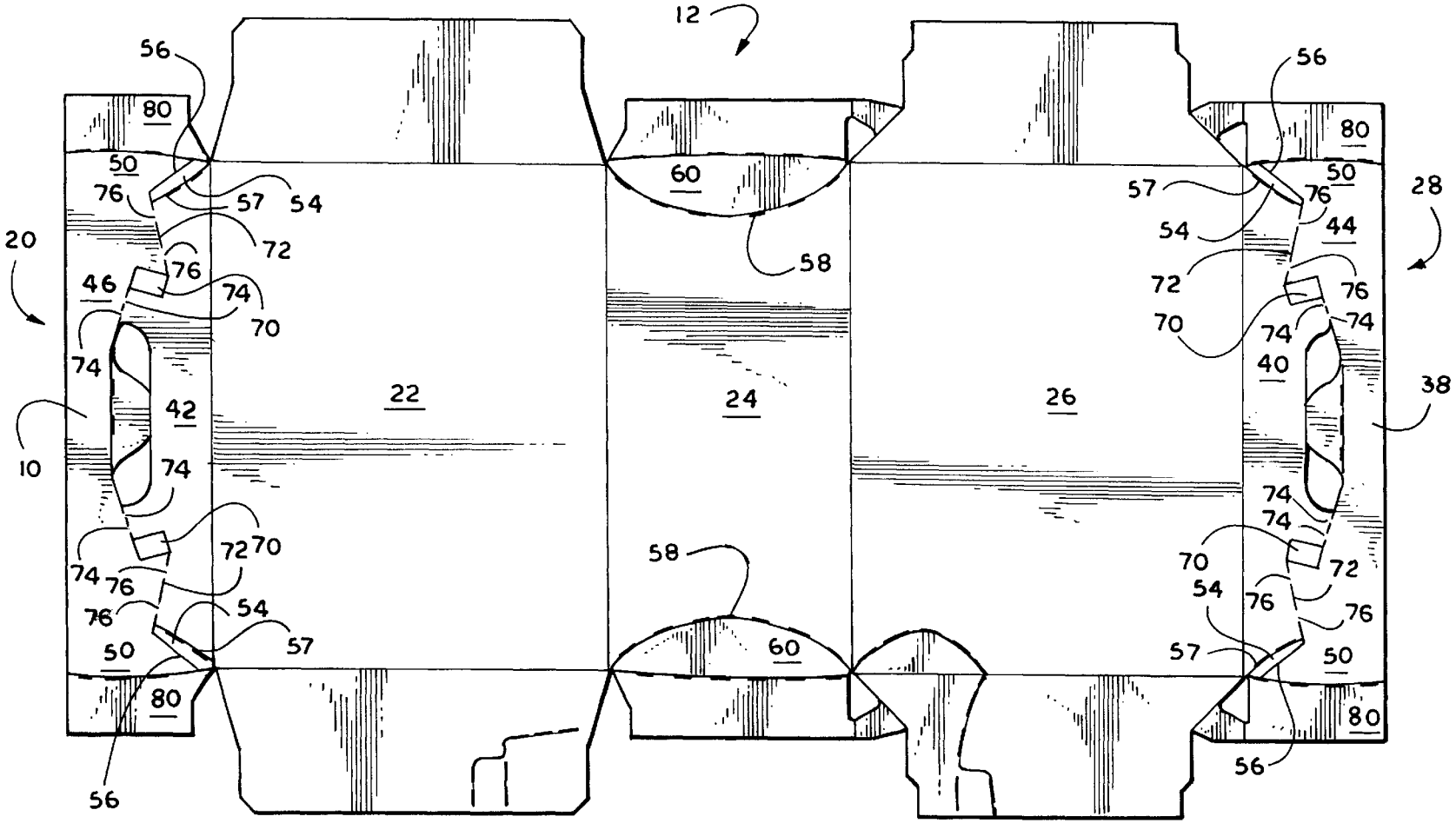
FIG. 3 is a plan view of a blank for forming the carton with the handle structure shown in FIG. 1.

For convenience of understanding, reference may be made to FIGS. 1, 2 and 3 simultaneously. FIGS. 1 and 2 illustrate a carton 10 having a handle structure in accordance with a preferred embodiment of the invention. FIG. 3 illustrates the blank 12 from which the carton of FIGS. 1 and 2 is formed.

FIG. 2 illustrates the transverse alignment of cans C with respect to the carton's handle structure in accordance with a preferred embodiment of the invention. FIG. 2 also depicts the manner in which the top wall of the carton 10 including its handle structure bows upwardly when a force F is applied to lift the strap member 14.

The environment of the handle structure of the invention is a carton 10 that forms an enclosure from a series of interconnected panels. In FIG. 3, the main adjoining panels 20, 22, 24, 26 and 28 which form a tubular structure when the end-most panels 20, 28 are joined are most clearly seen.

The end-most panels 20, 28 of the blank 12 form the top wall, or panel, of the carton 12 that contains the handle structure. For convenience of explanation, each portion of the top panel 20, 28 is further described in segments. Each half-panel has a strap member 46, 44 with a tapered region 30, 38 mediate the end regions. The remaining portion 40, 42 of the top panel lies along a side edge of the top panel. Flaps 80 adjoin the end edges of the top panel. Each flap forms at least a portion of an end wall in the erected carton.

In the erected carton 10, the strap members 46, 44 overlap, to a certain extent, and the tapered regions 30, 38 overlap fully to produce a substantially reinforced handle. At the end regions of the strap handle members 46, 44 a web extends diagonally from the vertex of a side edge and an end edge of the panel.

The elongated webs 54 are defined by a spaced-apart pairing of a perforated line 57 extending diagonally from the aforementioned vertex and a score line 56 lying between the perforated line and the end edge of the panel 20, 28. The intersection of the score line 56 and perforated line 57 enhances the effectiveness of the invention.

A connecting member 70 conjoins the strap member 46, 44 and a portion of the region 42, 40 of the top panel adjacent the strap member 46, 44. Stress upon the end region of the handle structure is more evenly directed toward the ends of the handle structure and carton through the coincidence of an edge 72 (appearing as a cut line in the blank 12) of the strap member 46, 44 with the score line 56 of the elongated web. Further enhancement of the operation of the handle structure is achieved by termination of the edge 72 at the connecting tab 70.

Optionally, the end regions of the top panel, which coincide with the end regions of the handle structure, may have an intermediate web panel 50 defined by a curved, or arcuate, score line 58, which, in the blank 12, coincides with the perforated lines 57 of the elongated webs of the handle structure. Another pair of intermediate web panels 60 may also be formed at the opposing side of the carton.

The strap member 44, 46 provides a handle that directs stress toward the ends of the carton. The features of the handle structure which are described above cause the strap member 30, 38 and other elements upon the top panel of the carton to flex, or bow, in an outwardly-projecting predetermined manner when the carton 10 is lifted F. The structure of the elongated webs 54 cause the top panel 20, 28 to concavely bow in a stepped configuration, ascending inwardly, when the carton is lifted by a force, as illustrated in FIG. 2. The tapered strap member 30, 38 provides a convenient, reliable handle. The connecting tabs 70 interconnect the strap member 46, 44 and adjacent top panel regions 42, 40. This interconnection causes the top panel 20, 28 to maintain a more contiguous configuration when the carton is lifted. The side regions 42, 40 of the top panel have a tendency to flex away from the strap member. The connecting tabs inhibit such movement and promote a more pleasing appearance and greater integrity of the top panel of the carton.

The intermediate web panels 50, 60 enable the comers of the carton 10 to be drawn tighter when cans C or similar articles are transversely aligned in the carton with respect to the lengthwise dimension of the carton and top panel, as shown in FIG. 2.

The structure of the invention provides a handle that is reinforced and that directs stress away from the handle itself to the ends of the carton while helping the carton to maintain an aesthetically pleasing appearance and greater integrity when lifted.

Modifications may be made in the foregoing without departing from the scope and spirit of the claimed invention.

What is claimed is:

1. A handle structure comprising:

a panel including opposing end edges and opposing side edges having a vertex formed at each intersection of one of said end edges and one of said side edges;

a strap member extending between said end edges having opposing end regions terminating at said end edges; and each said end region of said strap member having an elongated web extending diagonally from a respective said vertex including a perforated line and a score line in side by side relation to one another.

2. The handle structure of claim 1, further comprising at least one connecting tab intermediate said end regions of said strap member foldably interconnecting said strap member with a region of said panel intermediate said strap member and one of said side edges.

3. The handle structure of claim 1, wherein each said perforated line and an associated said score line intersect distal an associated said vertex.

4. The handle structure of claim 1, wherein said strap member is defined by opposing edges and a portion of at least one of said opposing edges of said strap member is coincident with said score line of at least one of said elongated webs.

5. The handle structure of claim 1, wherein said strap member tapers inwardly mediate said end regions forming a tapered region and at least one connecting tab proximate said tapered region foldably interconnects said strap member with a region of said panel intermediate said strap member and one of said side edges.

6. The handle structure of claim 5, wherein a portion of an edge of said strap member is coincident with said score line of at least one of said elongated webs and terminates at said connecting tab.

7. The handle structure of claim 1, wherein a flap extends from a respective one of said opposing end edges of said panel.

8. The handle structure of claim 1, wherein at least one of said opposing end regions of said strap member has a transverse arcuate fold line having ends substantially coincident with said perforated lines of said at least one of said opposing end regions.

9. The handle structure of claim 1, wherein said strap member is multiple-ply.

10. The handle structure of claim 1, wherein said score line is intermediate said perforated line and a proximate one of said side edges.

11. A blank for forming a carton having a handle structure, the blank comprising:

a plurality of adjoining panels for forming a carton enclosure including a panel having opposing end edges and at least one side edge having a vertex formed at each intersection of one of said end edges and one of said side edges;

a strap member extending between said end edges having opposing end regions terminating at said end edges; and each said end region of said strap member having an elongated web extending diagonally from a respective said vertex including a perforated line and a score line in side by side relation to one another.

12. The blank of claim 11 further comprising at least one connecting tab intermediate said end regions of said strap member foldably interconnecting said strap member with a region of said panel intermediate said strap member and one of said side edges.

13. The blank of claim 11, wherein each said perforated line and an associated said score line intersect distal an associated said vertex.

14. The blank of claim 11, wherein said strap member is defined by opposing edges and a portion of at least one of said opposing edges of said strap member is coincident with said score line of at least one of said elongated webs.

15. The blank of claim 11, wherein said strap member tapers inwardly mediate said end regions forming a tapered region and at least one connecting tab proximate said tapered region foldably interconnects said strap member with a region of said panel intermediate said strap member and one of said side edges.

16. The blank of claim 15, wherein a portion of an edge of said strap member is coincident with said score line of at least one of said elongated webs and terminates at said connecting tab.

17. The blank of claim 11, wherein a flap extends from a respective one of said opposing end edges of said panel having opposing end edges.

18. The handle structure of claim 11, wherein at least one of said opposing end regions of said strap member has a transverse arcuate fold line having ends substantially coincident with said perforated lines of said at least one of said opposing end regions.

19. The blank of claim 11, wherein said score line is intermediate said perforated line and a proximate one of said side edges.

20. A carton having a handle structure, the carton comprising:

a plurality of angularly interconnected walls forming an enclosure wherein at least one of said walls includes a panel having opposing end edges and opposing side edges having a vertex formed at each intersection of one of said end edges and one of said side edges;

a strap member extending between said end edges having opposing end regions terminating at said end edges;

each said end region of said strap member having an elongated web extending diagonally from a respective said vertex including a perforated line and a score line in side by side relation to one another; and a flap extending from a respective one of said opposing end edges of said panel forming at least a part of one of said interconnected walls that adjoins said opposing end edges.

21. The carton of claim 20, further comprising at least one connecting tab intermediate said end regions of said strap member foldably interconnecting said strap member with a region of said panel intermediate said strap member and one of said side edges.

22. The carton of claim 20, wherein each said perforated line and an associated said score line intersect distal an associated said vertex.

23. The carton of claim 20, wherein said strap member is defined by opposing edges and a portion of at least one of said opposing edges of said strap member is coincident with said score line of at least one of said elongated webs.

24. The carton of claim 20, wherein said strap member tapers inwardly mediate said end regions forming a tapered region and at least one connecting tab proximate said tapered region foldably interconnects said strap member with a region of said panel intermediate said strap member and one of said side edges.

25. The carton of claim 24, wherein a portion of an edge of said strap member is coincident with said score line of at least one of said elongated webs and terminates at said connecting tab.

26. The carton of claim 20, wherein at least one of said opposing end regions of said strap member has a transverse arcuate fold line having ends substantially coincident with said perforated lines of said at least one of said opposing end regions.

27. The handle structure of claim 20, wherein said strap member is multiple-ply.

28. The carton of claim 20, wherein said score line is intermediate said perforated line and a proximate one of said side edges.

29. A blank for forming a carton having a handle structure, the blank comprising:

a plurality of adjoining panels including a pair of bifurcate handle panels disposed for at least partial overlap for forming a handle wall panel of a carton enclosure each said bifurcate handle panel having a side edge and opposing end edges with a vertex formed at each intersection of said side edge and one of said end edges;

a strap member extending between said end edges having opposing end regions terminating at said end edges; and each said end region of said strap member having an elongated web extending diagonally from a respective said vertex including a perforated line and a score line in side by side relation to one another.

30. The blank of claim 29, further comprising at least one connecting tab intermediate said end regions of said strap member foldably interconnecting said strap member with a region of said panel intermediate said strap member and one of said side edges.

31. The blank of claim 29, wherein each said perforated line and an associated said score line intersect distal an associated said vertex.

32. The blank of claim 29, wherein said strap member is defined by opposing edges and a portion of at least one of said opposing edges of said strap member is coincident with said score line of at least one of said elongated webs.

33. The blank of claim 29, wherein said strap member tapers inwardly mediate said end regions forming a tapered region and at least one connecting tab proximate said tapered region foldably interconnects said strap member with a region of said panel intermediate said strap member and one of said side edges.

34. The blank of claim 33, wherein a portion of an edge of said strap member is coincident with said score line of at least one of said elongated webs and terminates at said connecting tab.

35. The blank of claim 29, wherein a flap extends from a respective one of said opposing end edges of said panel having opposing end edges.

36. The handle structure of claim 29, wherein at least one of said opposing end regions of said strap member has a transverse arcuate fold line having ends substantially coincident with said perforated lines of said at least one of said opposing end regions.

37. The blank of claim 29, wherein said score line is intermediate said perforated line and a proximate one of said side edges.

38. A package comprising:

a plurality of angularly interconnected walls forming an enclosure wherein at least one of said walls includes a panel having opposing end edges and opposing side edges having a vertex formed at each intersection of one of said end edges and one of said side edges;

a strap member extending between said end edges having opposing end regions terminating at said end edges;

each said end region of said strap member having an elongated web extending diagonally from a respective said vertex including a perforated line and a score line in side by side relation to one another;

a flap extending from a respective one of said opposing end edges of said panel forming at least a part of one of said interconnected walls that adjoins said opposing end edges; and a plurality of elongated articles transversely disposed with respect to said strap member within said enclosure.

39. The package of claim 38, further comprising at least one connecting tab intermediate said end regions of said strap member foldably interconnecting said strap member with a region of said panel intermediate said strap member and one of said side edges.

40. The package of claim 38, wherein each said perforated line and an associated said score line intersect distal an associated said vertex.

41. The package of claim 38, wherein said strap member is defined by opposing edges and a portion of at least one of said opposing edges of said strap member is coincident with said score line of at least one of said elongated webs.

42. The package of claim 38, wherein said strap member tapers inwardly mediate said end regions forming a tapered region and at least one connecting tab proximate said tapered region foldably interconnects said strap member with a region of said panel intermediate said strap member and one of said side edges.

43. The package of claim 42, wherein a portion of an edge of said strap member is coincident with said score line of at least one of said elongated webs and terminates at said connecting tab.

44. The package of claim 38, wherein at least one of said opposing end regions of said strap member has a transverse arcuate fold line having ends substantially coincident with said perforated lines of said at least one of said opposing end regions.

45. The package of claim 38, wherein said score line is intermediate said perforated line and a proximate one of said side edges.

* * * * *